United States Patent [19]

Cohen

[11] 4,130,978

[45] Dec. 26, 1978

[54] METHOD OF ASSEMBLING DISPOSABLE PIPETTE TIPS FOR SHIPMENT TO USERS THEREOF

[75] Inventor: Jules B. Cohen, Bayside, N.Y.

[73] Assignee: Medical Laboratory Automation, Inc., Mount Vernon, N.Y.

[21] Appl. No.: 772,312

[22] Filed: Feb. 25, 1977

Related U.S. Application Data

[60] Continuation of Ser. No. 631,185, Nov. 12, 1975, abandoned, which is a division of Ser. No. 154,143, Jun. 17, 1971, Pat. No. 3,937,322.

[51] Int. Cl.[2] ..... B65B 5/10

[52] U.S. Cl. ..... 53/444; 53/473; 206/499; 206/562

[58] Field of Search ..... 53/26, 35, 142, 159, 53/164; 206/486, 499, 562; 128/218 R

[56] References Cited

U.S. PATENT DOCUMENTS

| | | | |
|---|---|---|---|
| 1,305,908 | 6/1919 | Lanier | 206/499 X |
| 1,326,519 | 12/1919 | McLaren | 206/499 |
| 2,142,567 | 1/1939 | Levy | 206/486 |
| 3,039,881 | 6/1962 | Shapiro | 206/562 X |
| 3,494,201 | 2/1970 | Roach | 128/218 R |
| 3,690,453 | 9/1972 | Dorall | 53/26 X |

*Primary Examiner*—Horace M. Culver
*Attorney, Agent, or Firm*—William P. Keegan

[57] ABSTRACT

Disposable pipette tips are loosely fitted in an upright position through apertures in a tray which is supported to withstand a downward force exerted on a tip by a pipette which is inserted and wedged into a tip when attaching the same to the pipette. Means are provided to retain the loosely fitted tips in the tray during shipment of the tips to the user thereof.

1 Claim, 7 Drawing Figures

20
21
22
24
25
26
27
28
30
31
32
33
34
35
36
37
40
41

METHOD OF ASSEMBLING DISPOSABLE PIPETTE TIPS FOR SHIPMENT TO USERS THEREOF

This application is a continuation of application Ser. No. 631,185 filed Nov. 12, 1975, now abandoned, which, in turn, is a divisional application of application Ser. No. 154,143 filed June 17, 1971, now U.S. Pat. No. 3,937,322.

BACKGROUND OF THE INVENTION

This invention relates to disposable tips for pipettes and to the method of supplying such tips to the users thereof.

With the introduction of disposable items in the medical equipment supply field there has come a need for convenience packages for such items. By convenience, is meant that an appropriate number (depending on the item and its rate of use) of items must be packaged in a compact volume, the items must be readily accessible to the technician or other person using the item, and the item preferably is to be put into use without the necessity of the technician handling the item, particularly if the item is to contact biological fluids or the like.

Accordingly, the object of the present invention is to provide a method of supplying disposable tips to users so that the foregoing convenience features may be gained, especially that the need for manually handling the tips be obviated.

In carrying out the invention, there is provided a disposable pipette tip having a plurality of circumferentially spaced supporting ribs that support the tips as they are stacked one inside another without the walls of one tip contacting the interior of the tip into which it is stacked. The tips are placed in apertured trays such that the tips project through the tray but are supported thereon by their supporting ribs. When the trays are stacked one above another, the top of the pipette tips support the tray next above, while the downwardly projecting portion of the tip fits freely within the pipette tip stored in the tray next below. One or more stacks of pipette tip loaded trays are placed in an open top carton and this carton, in turn, is placed in a conventional flap top box or a sleeve type open ended box.

Features and advantages of the invention may be gained from the foregoing and from the description of a preferred embodiment of the invention which follows.

DETAILED DESCRIPTION OF THE INVENTION

In the drawing

Figures 1, 2, 3, 4, 7:
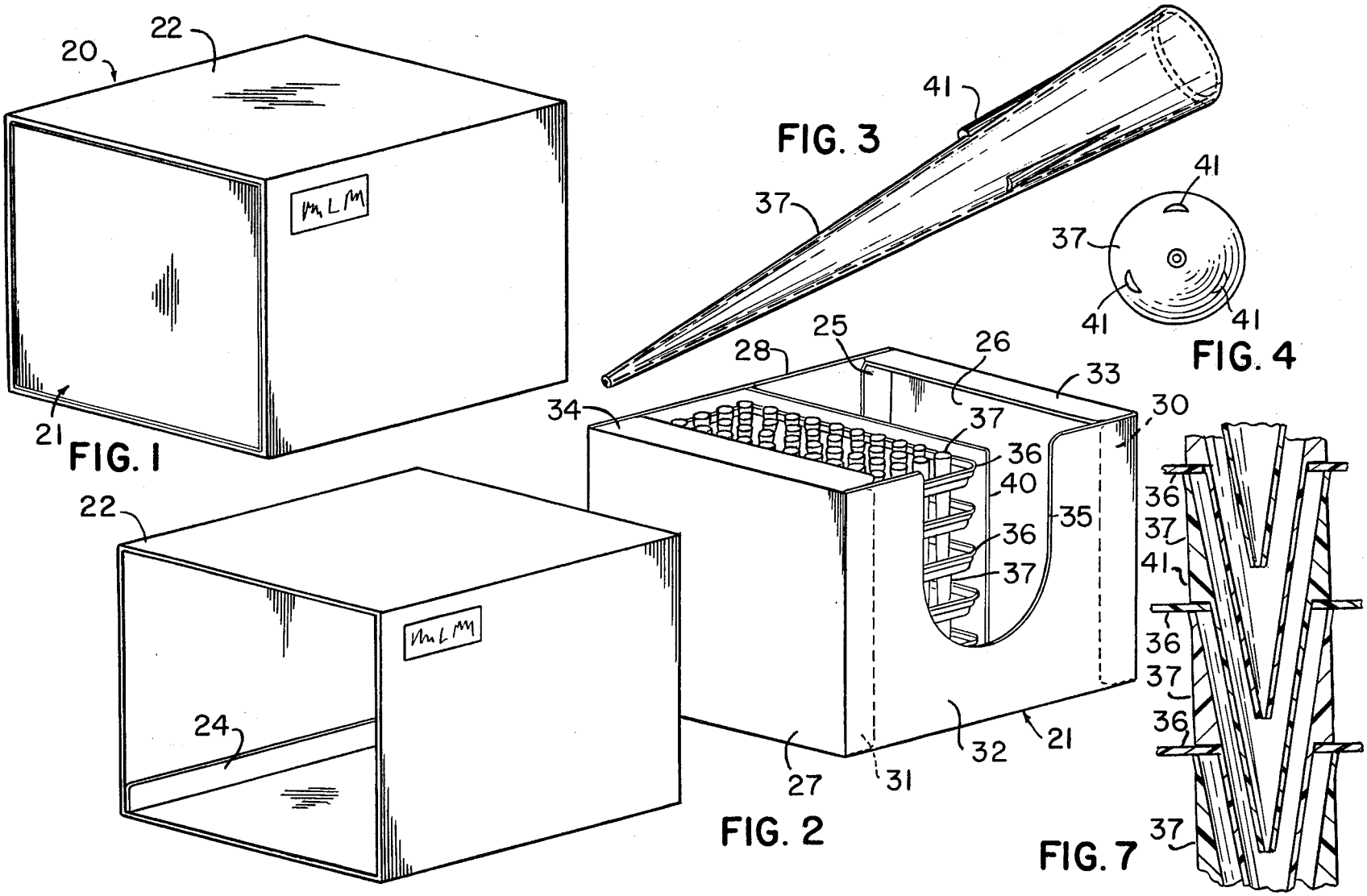
FIG. 1 is an isometric view of the pipette tip package.
FIG. 2 is an isometric exploded view showing the tip carton removed from a sleeve type box.
FIG. 3 is a perspective view of a disposable pipette tip.
FIG. 4 is a bottom view of the pipette tip.
FIG. 7 is an enlarged detail view showing especially how the disposable tips rest one inside another.

Reference is now made to the drawing wherein FIG. 1 shows the disposable tip package 20 as it would appear when filled and ready for marketing. Of course, the identification and other information normally printed on a package is not shown. Package 20 is seen to consist of an inner carton 21 and another sleeve type box 22 that slides over carton 21. Carton 21 could be placed in a regular flap top box if desired, but here the preference is for a sleeve type box.

In FIG. 2, box 22 is seen to be an open ended rectangular sleeve. It is formed by scoring a flat sheet of cardboard and folding it to the shape shown; a flap 24 is provided and it can be glued to the rear wall of the box. Carton 21 is seen to be essentially an open top container that can slide into either open end of box 22. Carton 21 also is formed by scoring a flat sheet of cardboard at what will be the edges of the carton. The flat sheet is shaped like a block cross with the two opposing arms that will be the ends being provided with three flaps along their open edges. In this way, when the container is formed by folding the scored cardboard sheet into a box shape, flap 25 on end 26 and its counterpart on end 27 can be glued to front wall 32. Flaps 33 and 34 simply fold over and partially close the top of the container; they help to keep dust or other contaminents out of the package when carton 21 is slipped into box 22. Front wall 32 of the carton is provided with a cut-out 35 as shown.

A stack of trays 36 with disposable pipette tips 37 are illustrated in one half of carton 21. A similar stack of trays and tips (not shown) would be packed in the other half of carton 21 with a sheet of cardboard 40 separating the two stacks. Or the carton could be of smaller size and hold only a single stack of trays and tips. The disposable tips 37 are simply hollow, generally conically shaped members, each formed with a number of lengthwise ribs 41 spaced around its outer surface. The tips 37 are preferably clear polypropylene, free of voids, inclusions and discolorations.

Figure 5:
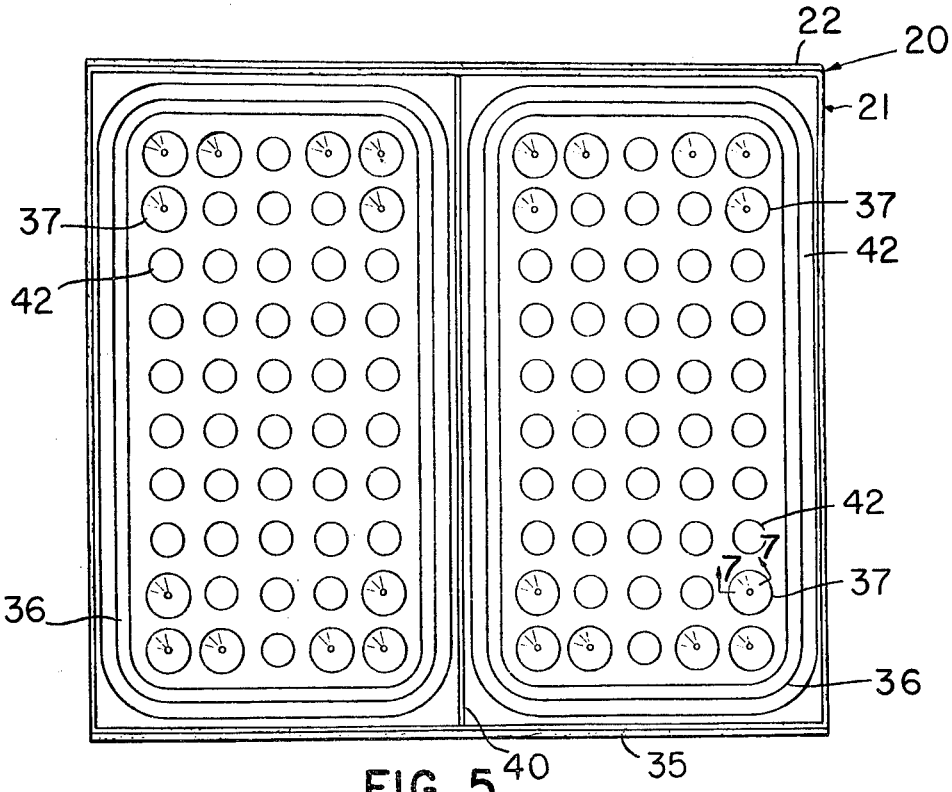
FIG. 5 is a top plan view of stacks of pipette tip trays with tips in their carton.
Figure 6:
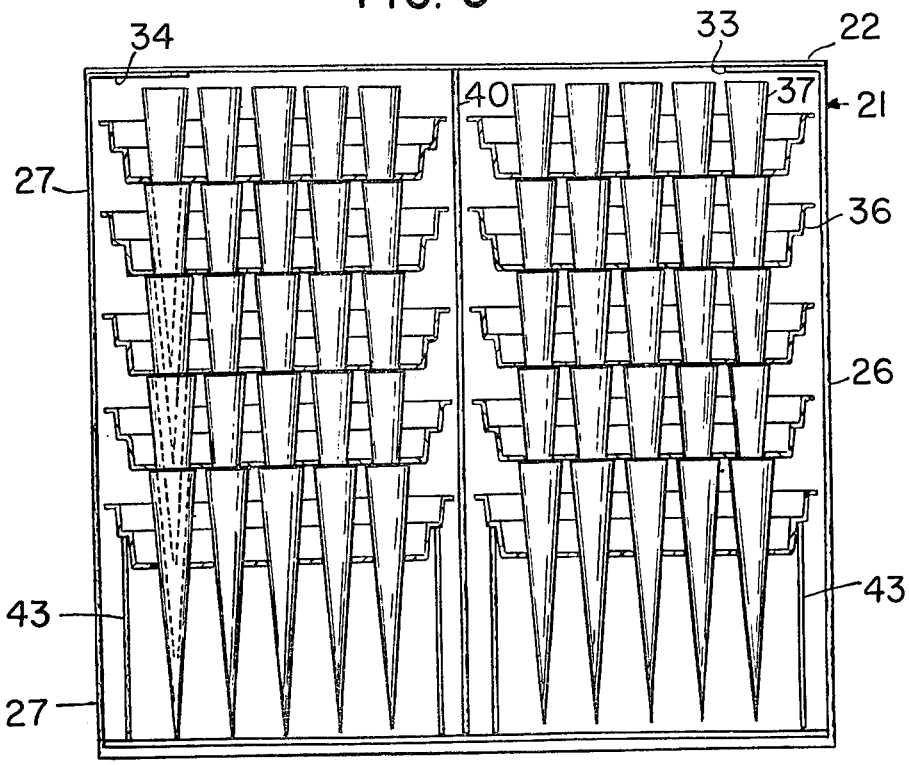
FIG. 6 is a front elevational view of stacks of pipette tip trays and tips in their carton with the front wall of the carton removed and the trays shown in section.

Attention is now directed to FIGS. 5, 6, and 7, and especially to the latter two figures, for a description of the compact manner in which the disposable tips are packaged, and the manner in which they can be put in use directly from their package. FIG. 5 being a top plan view of disposable tip package 20 with the top of box 22 removed is rather self-explanatory. It shows two stacks of trays 36 with a few representative tips 37 illustrated. The trays 36 are preferably formed of white styrene with fifty apertures provided therein for fifty of the disposable tips 37. The apertures 42 are dimensioned such that when a tip 37 is placed in one of them it will come to rest when the bottom surface or shoulders of ribs 41 contact the top surface of the tray. In other words, the diameter of the tips immediately below the bottom surfaces of ribs 41 is slightly less than the diameter of the apertures in the trays so that the tips fit loosely in the apertures. See FIG. 7 which illustrates this point.

If one looks at FIG. 6, it will be seen that the bottom tray 36 in carton 21 sits on a member 43 which supports the tray a distance above the bottom of the carton such that disposable tips in the tray do not touch the bottom of the carton. Trays 36 above the bottom tray are supported by the disposable tips in the trays next below. It will be observed (See FIG. 7) that the ribs 41 formed on the disposable tips extend far enough down the sides of the tips to separate two adjacent trays a distance far enough that the portion of one tip 37 extending through one tray 36 fits into the tip 37 immediately below without touching the interior wall of the lower tip. With such an arrangement there is no possibility of the tips being wedged one within another. Thus, when it is desired to remove a tip 37 from the carton 21, a pipette is simply pressed down into the tip so that the tapered pipette barrel frictionally engages the tapered interior wall of tip 37, and the tip removed from the tray. As noted above, a tip will never be stuck in the tip immediately below and its easy removal is always assured. When all of the tips 37 in the topmost tray have been used, the tray is discarded thereby exposing for use all of the tips in the next tray. Thus, when using disposable pipette tips packaged as taught by the present invention, there is no need for the technician to touch the disposable tips before their use in a pipetting operation.

Having thus described the invention, it is to be understood that many apparently different embodiments thereof can be conceived without departing from its spirit and scope. Therefore, it is intended that the foregoing description and the accompanying drawing be interpreted as illustrative rather than in a limiting sense.

What is claimed is:

1. The method of assembling disposable pipette tips in a multi-layered package from which a user can mount a tip on a pipette without manual handling of the tip, which method comprises the steps of providing a plurality of tips of the type having a generally conical shape with abutment means on the exterior surface of the tip, providing a first tray having a plurality of apertures therein each of which has a diameter slightly greater than the diameter of a tip at a point immediately below the tip abutment means, placing a plurality of pipette tips on said first tray so that each pipette tip is supported on the tray only by the tip abutment means and projects loosely through an aperture of the tray, providing support means having a height greater than the length of that portion of a disposable tip projecting through said first tray to support the periphery of said first tray so that a user of said tips can insert a pipette into a tip and apply a downward force on the pipette so as to wedge the tip onto the pipette without wedging the tip into the aperture through which it projects whereby the tip is secured to the pipette and by lifting the pipette can be removed from the tray, providing a second tray similar to said first tray with a plurality of pipette tips each supported thereon only by the tip abutment means so that a portion of each tip projects loosely through an aperture of said second tray, placing said second tray of pipette tips atop said first tray of pipette tips such that said second tray is supported by the pipette tips supported by said first tray and the pipette tips supported by said second tray project loosely into the pipette tips supported by said first tray whereby the pipette tips supported on said second tray can be removed from said second tray by inserting a pipette into the tip and applying a downward force on the pipette so as to wedge the tip onto the pipette without wedging the tip into the aperture through which it projects or into the tip into which it loosely projects, and providing means to retain said tips in their trays during shipment.

* * * * *